United States Patent [19]

Krueger

[11] 4,066,989

[45] Jan. 3, 1978

[54] TRIP UNIT TIE BAR HAVING INTEGRAL FLEXIBLY CONNECTED LINKS

[75] Inventor: Keith T. Krueger, Bellefontaine, Ohio

[73] Assignee: I-T-E Imperial Corporation, Spring House, Pa.

[21] Appl. No.: 681,245

[22] Filed: Apr. 28, 1976

[51] Int. Cl.[2] ..... H01H 75/00; H01H 77/00

[52] U.S. Cl. ..... 335/9; 337/50

[58] Field of Search ..... 335/8, 9, 10; 337/49, 337/50

[56] References Cited

U.S. PATENT DOCUMENTS

| | | | |
|---|---|---|---|
| 3,233,063 | 2/1966 | Platz | 335/9 |
| 3,422,381 | 1/1969 | Toth | 335/9 |

*Primary Examiner*—Harold Broome

*Attorney, Agent, or Firm*—Ostrolenk, Faber, Gerb & Soffen

[57] ABSTRACT

A multi-pole circuit breaker is provided with a molded common trip bar means including a bar having integrally formed bearings defining a pivot axis remote from the bar, integrally formed links individually connected to the overload sensing means of each pole, and an integrally formed projection for releasing a latch of a trip free contact operating means.

13 Claims, 11 Drawing Figures

TRIP UNIT TIE BAR HAVING INTEGRAL FLEXIBLY CONNECTED LINKS

This invention relates to multipole circuit breakers in general and more particularly relates to a novel common trip bar means.

Co-pending Application Ser. No. 681,243 filed on even date herewith, entitled "IMPROVED UNITIZED COMBINATION STARTER", and assigned to the assignee of the instant invention, discloses a combination motor starter including a multi-pole circuit breaker in which the pole units, including the current carrying elements, are disposed in adjacent side-by-side compartments and a single contract operating mechanism is disposed at one side of the pole units. Each pole unit is provided with a so-called instantaneous automatic trip means in which the coil of an electromagnet is used to sense overloads. Upon the occurrence of an overload in one of the poles, an electromagnet in this pole is energized to operate a common trip bar for release of the trip latch for the common contact operating means.

In accordance with the instant invention the trip bar and all extensions thereof are constructed as a single molded plastic element. In particular, the trip bar means includes an elongated bar having bearings at opposite ends thereof defining a pivot axis parallel to and laterally offset from the longitudinal axis of the bar. Rods extending radially from the bar constitute links that engage the automatic trip means for the individual pole units. These links are constructed to provide lost motion connections so that the trip devices of each pole unit may operate independently of one another. The links are flexibly connected to the bar by integral sections of reduced cross-section. The trip bar is provided with another lateral projection disposed outboard of the elongated bar for releasing the contact operating mechanism latch when the trip bar is pivoted.

Accordingly, a primary object of the instant invention is to provide a novel construction for a common trip bar means of a multi-pole circuit breaker.

Another object is to provide a trip bar means of this type comprising a single molded element.

Still another object is to provide a trip bar means of this type having lateral extensions for connection to individual fault sensing devices with these lateral extensions being flexibly connected to the bar of the trip bar means.

A further object is to provide a trip bar means of this type having a plurality of lateral extensions constructed to provide lost motion connections with automatic trip devices in each pole of the circuit breaker.

These objects as well as other objects of this invention shall become readily apparent after reading the following description of the accompanying drawings in which:

In FIG. 10 the magnet is deenergized and in FIG. 11 the magnet is energized.

Figure 4:
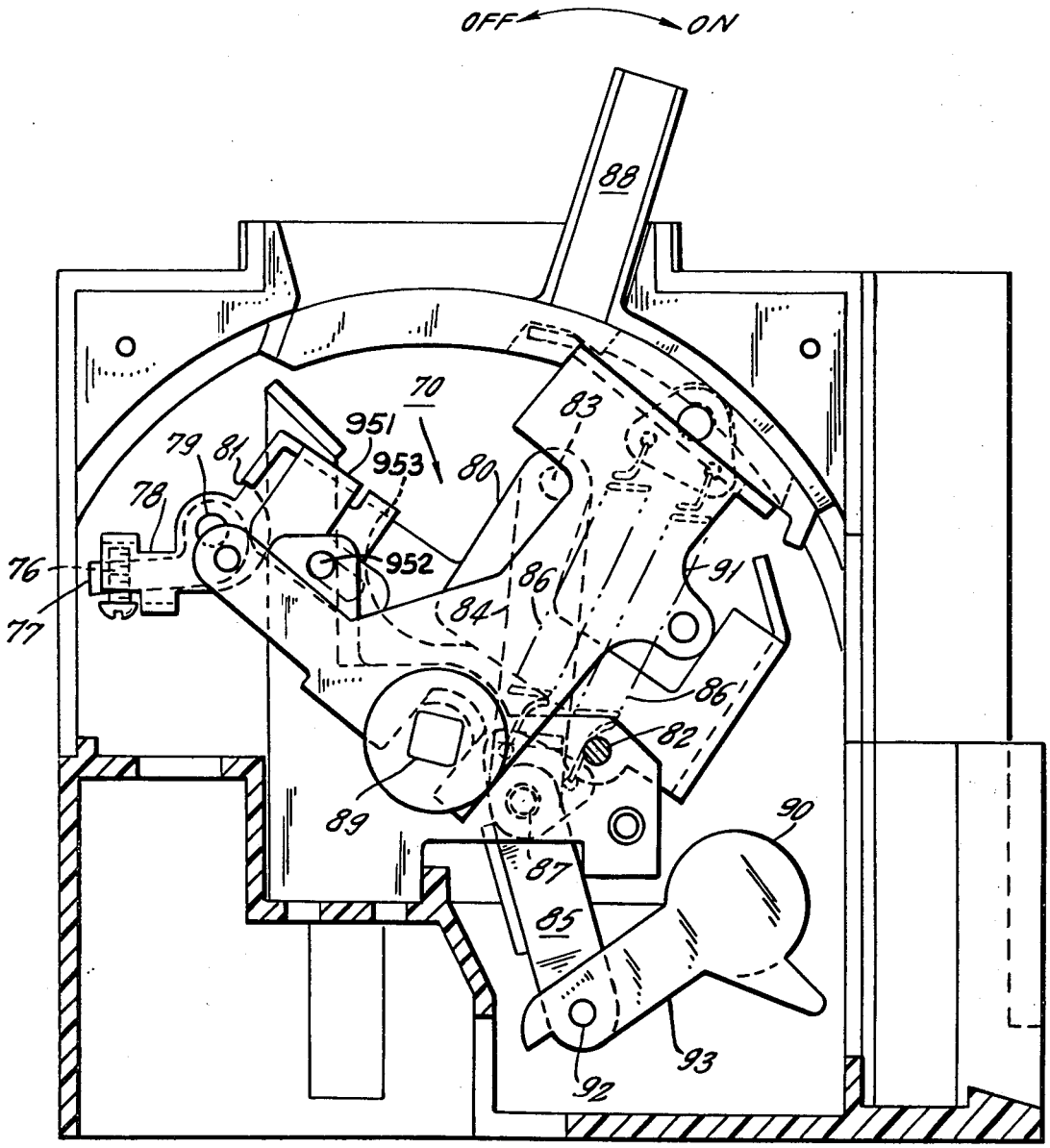
FIG. 4 is a cross-section taken through line 4—4 of FIG. 1 looking in the direction of arrows 4—4 and showing the elements of the circuit breaker manual operating mechanism in contact closed position.

Now referring to the Figures. Unitized combination motor starter 20 includes a molded insulating housing consisting of base 21 and removable shallow front cover 22 secured in operative position by screws 19. Cover 22 includes longitudinally extending parallel ribs that mate with similar ribs 24, 25, 26 in base 21 to form elongated parallel compartments. Three of these compartments have current carrying elements identical to those illustrated in the right hand portion of FIG. 2, and constitute a pole of the three pole circuit breaker portion 59 of starter 20. Removable side cover 67 is provided for the compartment which encloses spring powered trip free contact operating mechanism 70 of FIG. 4.

Figure 2:
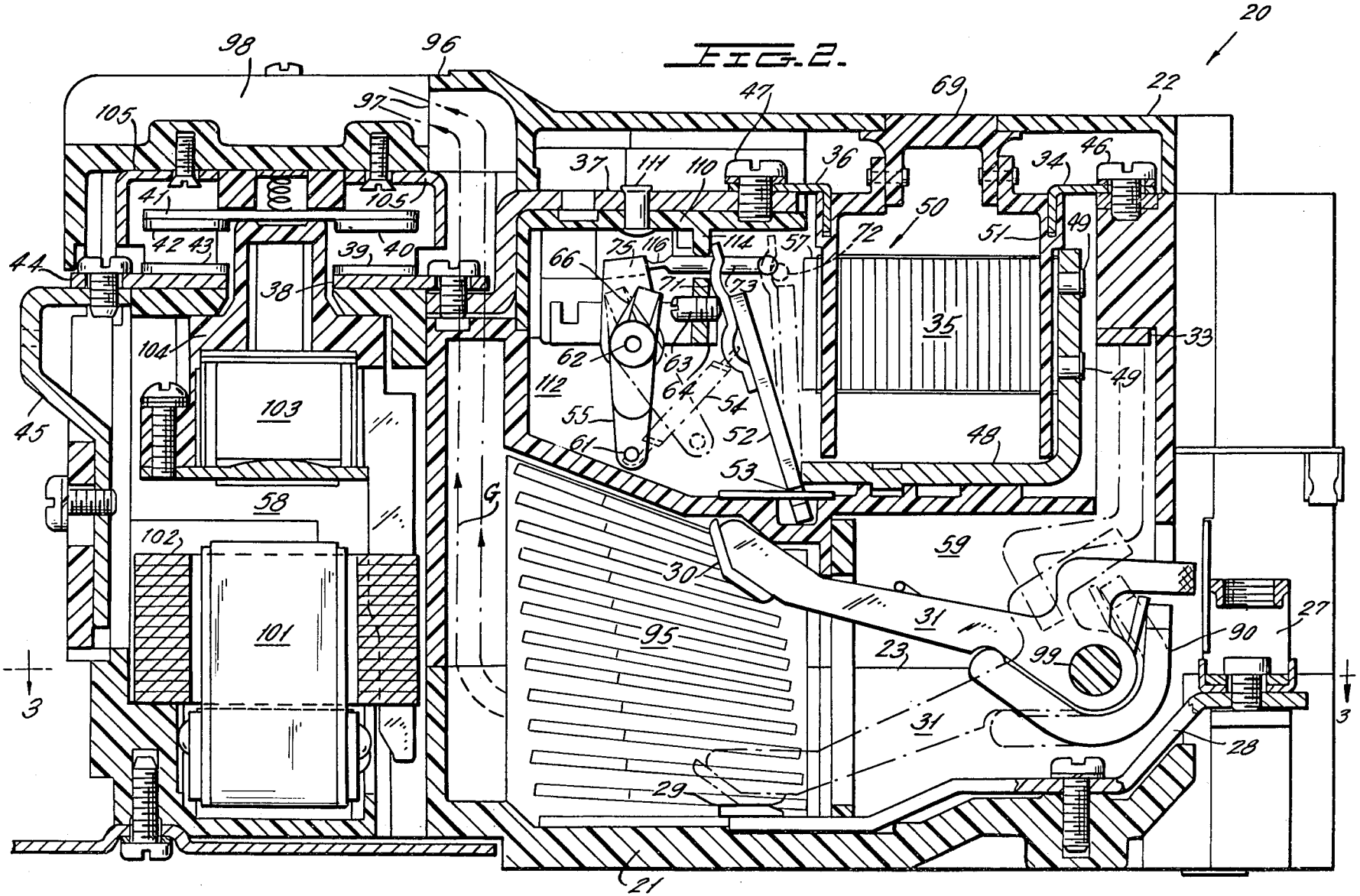
FIG. 2 is a cross-section taken through line 2—2 of FIG. 1 looking in the direction of arrows 2—2 and showing the elements of one pole unit.
Figure 3:
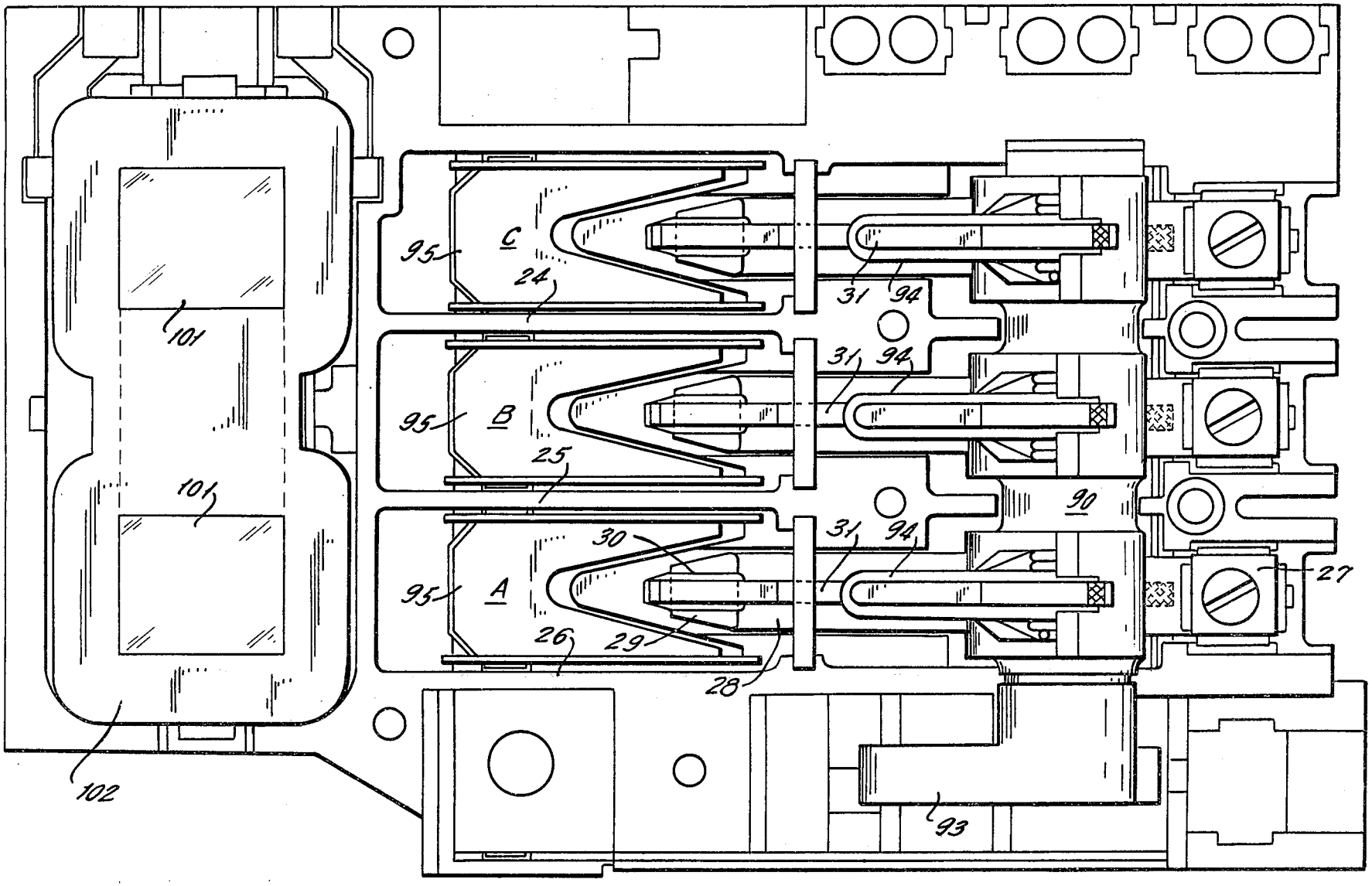
FIG. 3 is a cross-section taken through lines 3—3 of FIG. 2 with the circuit breaker contacts closed, looking in the direction of arrows 3—3.

The current carrying path for each pole A, B, C of starter 20 is identical so that only one of these paths shall be described with particular reference to FIG. 2. This current path includes wire grip 27 at one end of line terminal strap 28, strap 28, stationary contact 29 at the other end of strap 28, movable contact 30 at one end of movable contact arm 31, arm 31, flexible braid 32 at the other end of arm 31, U-shaped strap 33, coil terminal 34, coil 35, the other terminal 36 for coil 35, conducting straps 37 and 38, stationary contact 39 of electromagnetic contactor portion 58 of starter 20, movable contactor contact 40, conducting bridge 41, movable contactor contact 42, stationary contactor contact 43, conducting strap 44, and load terminal strap 45. The latter is constructed so as to be connectible directly to a load or to be connectible to a load through a conventional overload relay (not shown).

Figure 1:
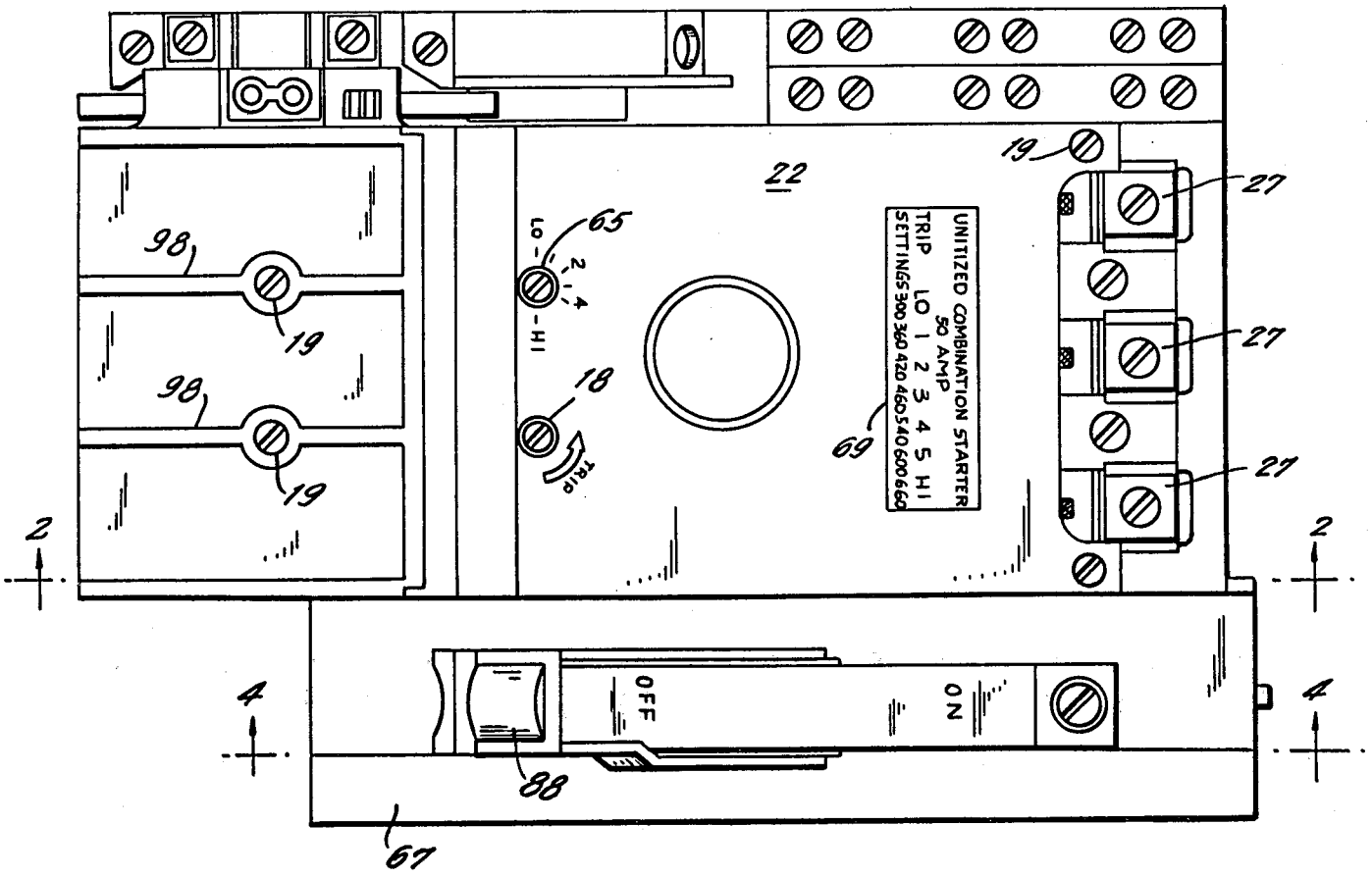
FIG. 1 is a plan view of a unitized combination motor starter including trip bar means constructed in accordance with teachings of the instant invention.

Coil 35 is part of circuit breaker calibrating assembly 50 removable and replaceable from the front of starter 20 after front cover 21 is removed. The calibrating assemblies 50 of all three poles may be individual units or they may be connected to a common insulating member 69 (FIG. 1) so that all three assemblies 50 must be removed as a unit.

Each subassembly 50 is electrically and mechanically secured in operative position by a pair of screws 46, 47 that are accessible when cover 22 is removed from base 21. Coil 35 is wound about bobbin 57 that surrounds one leg of stationary C-shaped magnetic frame 48. The latter is secured by rivets 49, 49 to insulator 51 having terminal 34 and bobbin 57 mounted thereto. The magnetic frame also includes movable armature 52 which is pivotally mounted at its lower end in the region indicated by reference numeral 53 so that the upper end of armature 52 may move toward and away from stationary frame portion 48. Coiled tension spring 54 is connected to pin formation 61 at the edge of radial adjusting bar 55 remote from its pivot provided by pins 62. Thus, spring 54 biases the forward end of armature 52 away from magnetic frame 48.

Figure 5:
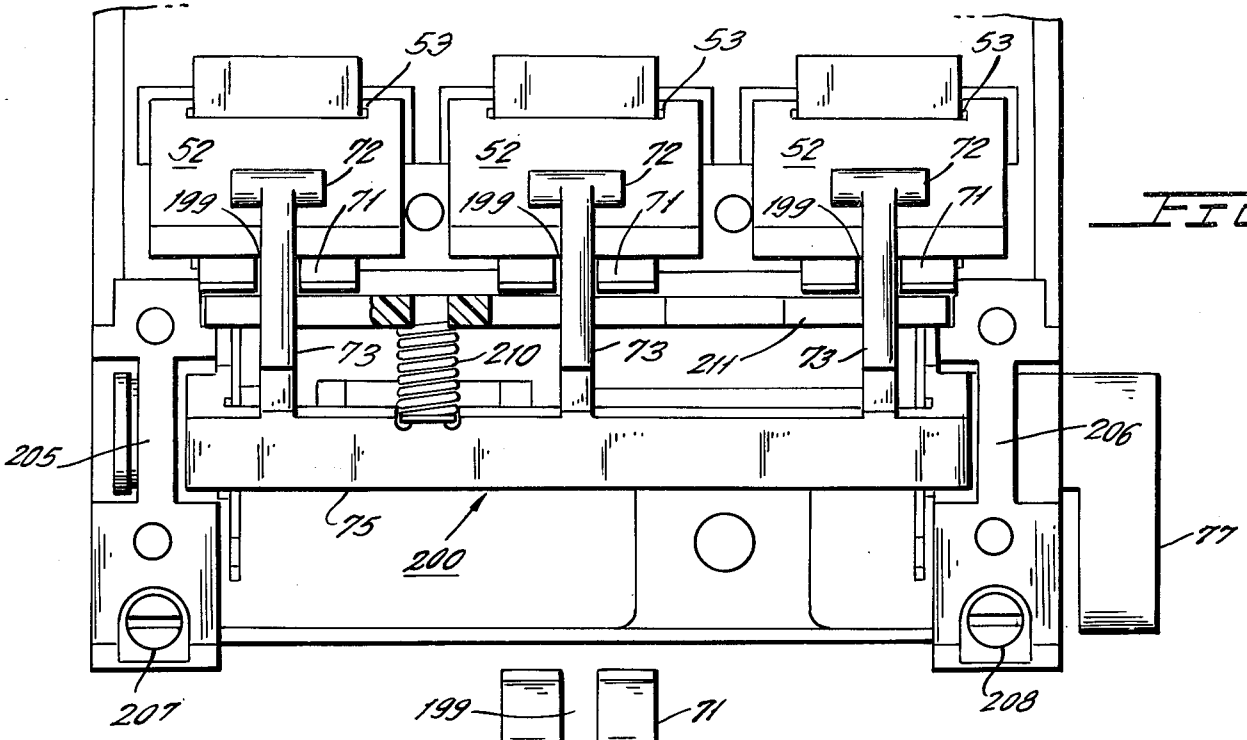
FIG. 5 is a plan view looking into the tripper bar compartment through the front thereof.

The air gap adjustment between armature 52 and frame 48 is set by screw 63 which is threadably mounted to transverse member 64. A cam (not shown) at the rear of pivotable adjusting control 65 engages extension 66 of member 55 to adjust the tension on all three springs 54 without changing the air gaps between any of the armatures 52 and their associated stationary frame sections 48. Control 65 extends through and is journalled for movement within aperture 65*a* of auxiliary cover 110 (FIG. 5). Turn-to-trip control 18 extends through and is journalled for movement within aperture 18*a* of auxiliary cover 110. Both controls 65 and 18 are accessible for operation through apertures in main cover 22.

Upon the occurrence of predetermined fault current conditions the flux generated by current flowing in coil 35 attracts armature 52 to stationary frame 48 causing bifurcated armature bracket 71 to engage enlarged formation 72 on transverse extension 73 of common tripper bar 75. The latter is part of tripper bar means 200 which shall be described hereinafter in greater detail. This pivots the latter clockwise about an axis which coincides with axis 62 for adjusting bar 55 which causes screw 76 on tripper bar extension 77 to pivot latch member 78 in a clockwise or tripping direction about its pivot 79, thereby releasing latching point 81 of latch plate 951 on pivot 952 thereby releasing latching point 953 of cradle 80 so that the latter is free to pivot clockwise, about pivot 82. As cradle 80 pivots clockwise, end 83 of upper toggle link 84 moves up and to the right with respect to FIG. 4 permitting coiled tension springs 86, connected between toggle knee 87 and manual operating handle 88 to collapse toggle 84, 85 and move handle 88 to the left. The latter is pivoted about center 89 through a connection between handle 88 and its rearward extension 91.

The lower end of lower toggle link 85 is pivotally connected at 92 to the free end of radial extension 93 of contact carrier 90. This causes carrier 90 to pivot clockwise with respect to FIG. 4 and by so doing moves the contact arms 31 of all three poles to the solid line or open circuit position of FIG. 2. It is noted that base 21 is a multipart unit having sections which mate along dividing line 23 so that the reduced diameter bearing portions of contact carrier 90 may be inserted and captured in operative positions. In the closed position of circuit breaker portion 59 an individual torsion spring 94, interposed between carrier 90 and movable contact arm 31, biases arm 31 counterclockwise about insulating rod 99 as a center and thereby generates contact pressure.

For each pole A, B, C an individual parallel plate arc chute 95 is provided to facilitate extinction of arcs drawn between circuit breaker contacts 29, 30 upon separation thereof. Arcing gases exiting from arc chute 95 at the left thereof with respect to FIG. 2 migrate forward as indicated by the dash lines G and are directed by hooded portion 96 of cover 22 to exit through opening 97 and flow to the left with respect to FIG. 2 in front of contactor section 58. External cover barriers 98 serve to prevent direct mixing of arcing gases from different poles at the instant these gases leave housing 21, 22 through exit openings 97.

The electrical and magnetic elements of contactor 58 are generally of conventional construction and include U-shaped magnetic yoke 101 whose arms are surrounded by portions of coil 102. When the latter is energized, armature 103 is attracted to yoke 101 and carries contact carrier 104 rearward. The latter mounts are bridging contacts 41 of all three poles so that contacts 41 move to their closed position wherein movable contacts 40, 42 engage the respective stationary contacts 39, 43. Steel elements 105 mounted to the inside of cover 22 are positioned in the regions of the contactor contacts 39, 40, 42, 43 whereby extinction of arcs drawn between these contacts upon separation thereof is facilitated through magnetic action.

Rivet 111 (FIG. 2) secures conducting strap 37 on the forward surface of insulating cover 110 of L-shaped cross-section. The latter forms the forward boundary for chamber 112 wherein common tripper bar 75, adjusting bar 55 and armatures 52 are disposed. After the removal of main cover 22, auxiliary cover 110 is removable for access to adjusting screws 63. The rear surface of cover 110 is provided with protrusions 114 which engage and guide movement of extension 73.

Figure 7:
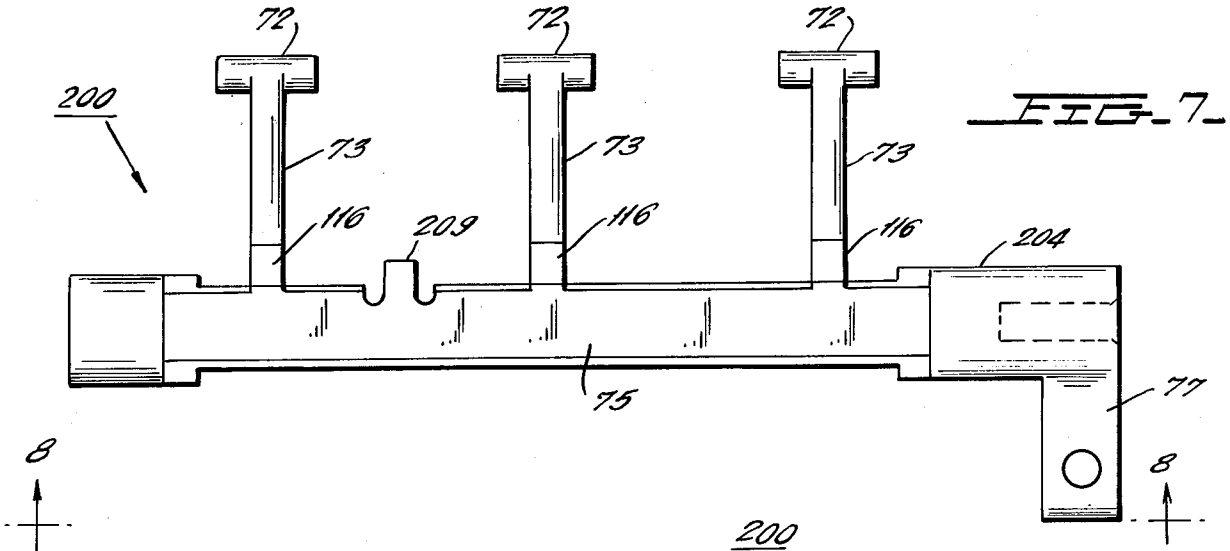
FIG. 7 is a plan view of a trip bar means.
Figure 8:
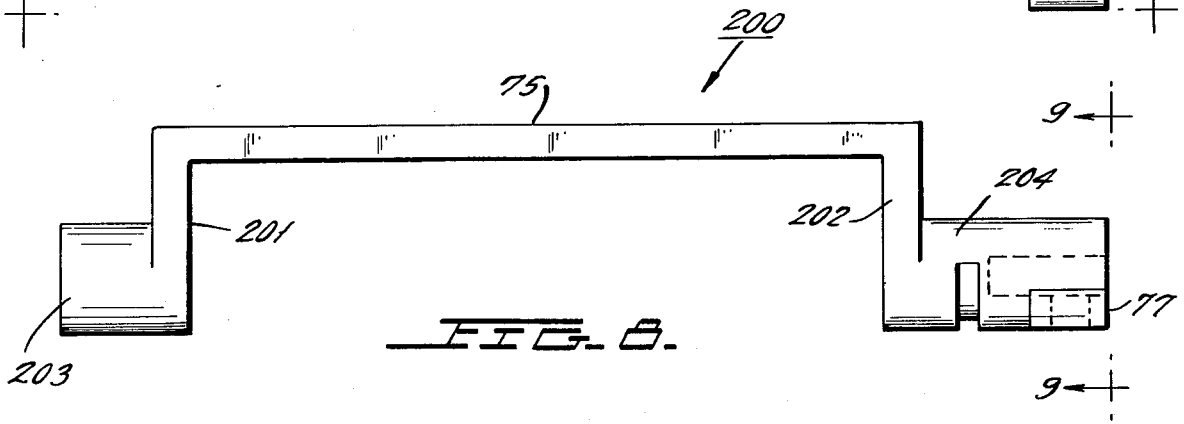
FIG. 8 is an elevation of the trip bar means looking in the direction of arrows 8—8 of FIG. 7.
Figure 9:
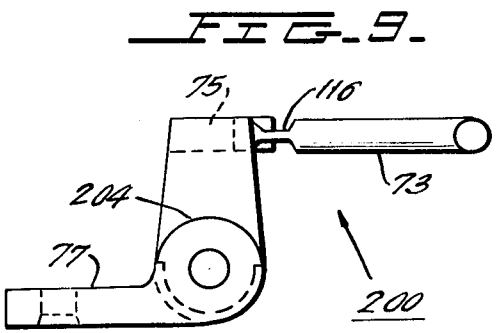
FIG. 9 is a end view of the trip bar means looking in the direction of arrows 9–9 of FIG. 8.

With particular reference to FIGS. 7 through 9 it is seen that trip bar means 200 is a single element molded of plastic such as the acetal resin identified by the trade name Delrin. Reduced cross-section joining locations 116 which connect links 73 to bar 75 are resilient so that links 73 are biased forward into engagement with guide formations 114. Transverse arms 201, 202 at opposite end of bar 75 connect the latter to cylindrical bearing sections 203, 204 that define a pivot axis for trip bar means 200 which is parallel to and laterally offset from bar 75. Bearing sections 203, 204 are engaged by split bearing retainers 205, 206 (FIG. 5) which are secured within base 21 by screws 207, 208.

Figure 6:
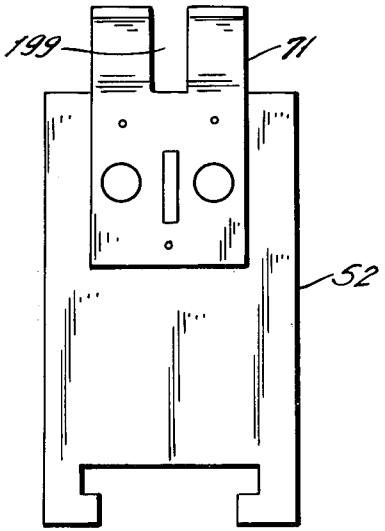
FIG. 6 is an elevation of a trip unit armature looking from left to right with respect ot FIG. 2.
Figure 11:
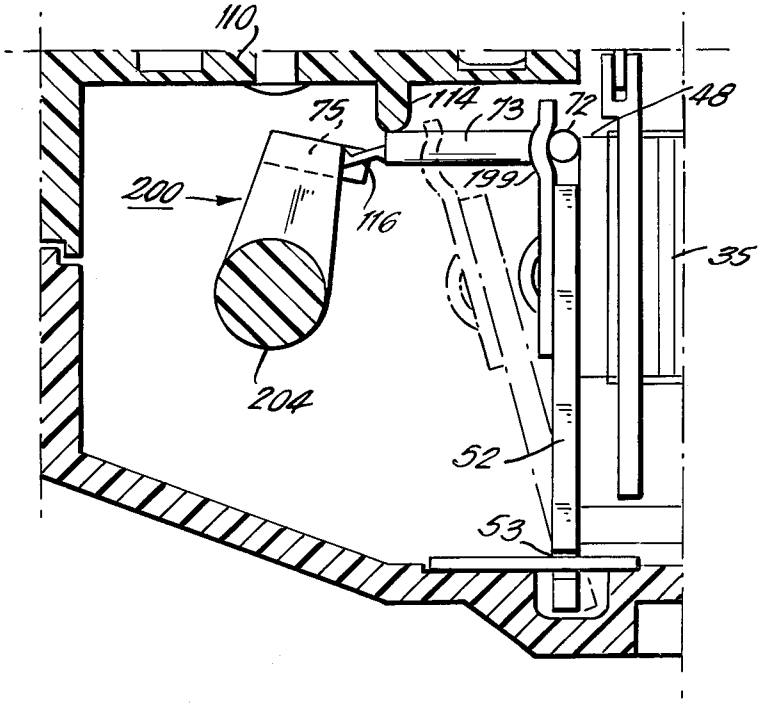
FIGS. 10 and 11 are side elevations showing the relationship between the trip bar means and an overload sensing magnet.
Figure 10:
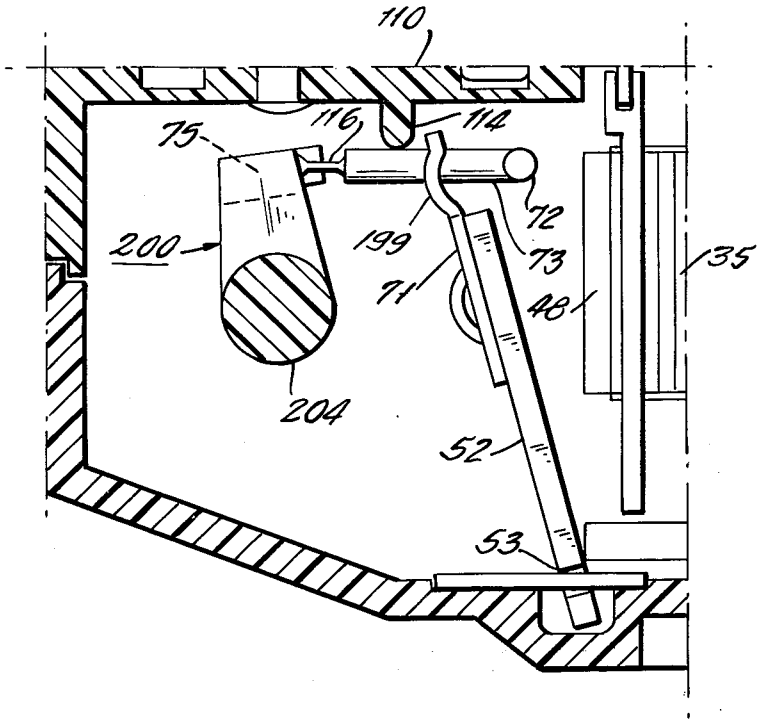

Transverse projection 209 of bar 75 provides a connecting point for coiled compression spring 210 (FIG. 5) which bears against surface 211 to bias trip bar means 200 to its reset position shown in FIG. 10. In this position enlarged formation 72 at the free end of link 73 is to the right of armature bracket 71. When predetermined overload current conditions exist in one of the poles A, B, C the armature 52 in this pole will pivot clockwise to the solid line position of FIG. 11. During this movement of armature 52, bracket 71 carried by armature 52 engages formation 72 to move link 73 to the right with respect to FIG. 10 thereby pivoting trip bar means 200 in a clockwise direction to trip cradle latch member 78 of contact operating mechanism 70, as previously described. During this movement of trip bar means 200, in each non-faulted pole 73 slides through slot 199 (FIG. 6) which provides a lost motion connection between link 73 and armature 52.

For more detailed descriptions of certain elements illustrated in the drawings reference is made to one or more of the following co-pending U.S. Patent applications Ser. Nos. 681,243, 681,250, 681,253, 681,244, all filed on even date herewith.

Although a preferred embodiment of this invention has been described, many variations and modifications will now be apparent to those skilled in the art, and it is therefore preferred that the instant invention be limited not by the specific disclosure herein but only by the appending claims.

The embodiments of the invention in which an exclusive privilege or property is claimed are defined as follows:

1. A multipole circuit breaker including cooperating contact means for each pole thereof, an operating mechanism operatively connected to said contact means, latch means for maintaining a releasable portion of said operating mechanism in a reset position wherein said operating means is effective to close said contact means, an automatic trip means including an individual overload sensing means for each of said poles, said automatic trip means including a common trip bar means comprising a single elongated plastic element, said element including first means defining a pivot axis for said trip bar means, second means operatively connected to said latch means, third means for each of said poles extending laterally from joining locations remote from said axis into operative engagement with said automatic trip means whereby operation of the latter is effective to pivot said trip bar means about said pivot axis causing said second means to trip said latch means to release said portion whereby said operating mechanism opens said contact means, said element also including an elongated bar having its axis generally parallel to and laterally offset from said pivot axis; said joining locations being spaced along said bar.

2. A multipole circuit breaker as set forth in claim 1 in which the third means is elongated, fourth means connecting said third means to said bar at said joining locations whereby the third means is movable with respect to the bar about an individual axis positioned generally parallel to the pivot axis.

3. A multipole circuit breaker as set forth in claim 2 in which each of the third means is movable about its individual axis independently of movement of each of the other third means about its individual axis.

4. A multipole circuit breaker as set forth in claim 3 in which each of the individual axes is defined by a portion having a cross-section reduced to an extent such that the portion is flexible.

5. A multipole circuit breaker as set forth in claim 1 in which each of the third means is constructed to form a lost motion connection with said automatic trip means.

6. A multipole circuit breaker as set forth in claim 1 in which each of said third means includes an elongated link, flexible means operatively connecting one end of said link to said bar at said joining location and, at the other end of said link, an enlargement for operative connection with a circuit breaker trip unit.

7. A multipole circuit breaker as set forth in claim 1 in which the first means includes first and second bearing sections disposed outboard of said bar at opposite ends thereof.

8. A multipole circuit breaker as set forth in claim 7 in which the second means projects from one of said bearing sections.

9. A multipole circuit breaker as set forth in claim 6 in which the flexible means is formed by a section of said common trip bar means having a relatively thin cross-section.

10. A multipole circuit breaker as set forth in claim 9 in which the first means includes first and second bearing sections disposed outboard of said bar at opposite ends thereof.

11. A multipole circuit breaker including cooperating contact means for each pole thereof, an operating mechanism operatively connected to said contact means, latch means for maintaining a releasable portion of said operating mechanism in a reset position wherein said operating means is effective to close said contact means, an automatic trip means including an individual overload sensing means for each of said poles, said automatic trip means including a common trip bar means comprising an elongated bar, first means defining a pivot axis for said bar, second means operatively connecting said bar to said latch means, third means for each of said poles extending laterally from said bar at locations remote from said axis and spaced along the length thereof, said third means being in operative engagement with said automatic trip means whereby operation of the latter is effective to pivot said trip bar means about said pivot axis causing said second means to trip said latch means to release said portion whereby said operating mechanism opens said contact means, each of said third means being flexible with respect to said bar.

12. A multipole circuit breaker as set forth in claim 11 in which each of said third means includes an elongated link, having at its end remote from said bar, an enlargement for operative connection with a circuit breaker trip unit.

13. A multipole circuit breaker as set forth in claim 12 in which the longitudinal axis of the bar is generally parallel to and laterally offset from said pivot axis.

* * * * *